United States Patent [19]

Warwick

[11] Patent Number: 4,773,554

[45] Date of Patent: Sep. 27, 1988

[54] CRATE

[75] Inventor: Michael J. Warwick, Randburg, South Africa

[73] Assignee: Teknol Holdings, Inc., St. Helier, Channel Islands

[21] Appl. No.: 131,305

[22] Filed: Dec. 7, 1987

Related U.S. Application Data

[63] Continuation of Ser. No. 836,316, Mar. 5, 1986, abandoned.

[30] Foreign Application Priority Data

Jul. 22, 1985 [ZA] South Africa ..... 85/5529

[51] Int. Cl.[4] ..... B65D 1/21; B65D 21/02

[52] U.S. Cl. ..... 220/21; 206/427; 206/503; 206/509; 220/DIG. 15

[58] Field of Search ..... 220/21, DIG. 15; 206/203, 427, 503, 509; 217/6, 25.5, 19

[56] References Cited

U.S. PATENT DOCUMENTS

| | | | |
|---|---|---|---|
| 2,935,222 | 5/1960 | O'Connell | 217/19 |
| 2,970,715 | 2/1961 | Kapple et al. | 220/21 |
| 3,151,762 | 10/1964 | Vidal | 220/DIG. 15 |
| 3,349,943 | 10/1967 | Box | 220/21 |
| 3,390,801 | 7/1968 | Adomat | 220/21 |
| 4,037,722 | 7/1977 | Bremer | 206/203 |
| 4,095,720 | 6/1978 | Delbrouck et al. | 220/21 |
| 4,162,738 | 7/1979 | Wright | 220/21 |
| 4,204,596 | 5/1980 | Davis | 220/21 |
| 4,319,685 | 3/1982 | David | 220/21 |

FOREIGN PATENT DOCUMENTS

| | | | |
|---|---|---|---|
| 247904 | 8/1962 | Australia | 217/19 |
| 693216 | 9/1967 | Belgium . | |
| 689893 | 10/1979 | U.S.S.R. | 220/21 |
| 1120067 | 7/1968 | United Kingdom | 220/21 |
| 2158044 | 11/1985 | United Kingdom | 206/427 |

*Primary Examiner*—George E. Lowrance
*Attorney, Agent, or Firm*—Ladas & Parry

[57] ABSTRACT

A bottle crate has an upper part which is upwardly open and a lower part receivable in an upper part of an identical subjacent crate and having a single, lowermost, relatively-smooth floor. Separating posts extend upwardly from the floor to provide upwardly opening primary sockets in which lower portions of bottles are receivable. Each primary socket has a seat on which a lower part of a bottle received in the primary socket is supportable. The crate also has downwardly opening secondary sockets within which neck portions of bottles in a subjacent crate are receivable in use.

13 Claims, 12 Drawing Sheets

CRATE

This is a continuation of co-pending application Ser. No. 836,316, filed on Mar. 5, 1986, now abandoned. This invention relates to a crate. More particularly, it relates to a bottle crate.

According to the invention there is provided a bottle crate which includes an upper part which is upwardly open;

a lower part including a floor, the lower part of the crate being receivable in an upper part of an identical subjacent crate;

separating means extending upwardly away from the floor at least partially to define upwardly opening primary sockets in which at least lower portions of bottles are receivable;

supporting means above the floor at a height less than that of the separating means to provide each primary socket with a seat on which a lower part of a bottle received in the primary socket is supportable; and downwardly opening secondary sockets within which neck portions of bottles in a subjacent crate are receivable in use.

The crate may include a peripheral wall extending upwardly from and surrounding the floor. In an elongated rectangular crate, this peripheral wall will have two side portions, and two end portions. The side and end portions may be suitably shaped so that an upper part of each portion forms part of the upper part of the crate and a lower part of each portion forms part of the lower part of the crate. For example, the portions mah be stepped to facilitate at least partial location of the lower part of the crate within the upper part thereof. This can provide a stepped formation or rebate where the upper and lower parts of the wall meet. Thus, when a crate is stacked on top of a subjacent crate, the floor and lower part of the wall fits within the upper part of the subjacent crate and the upper part of the wall rests on the upper part of the wall of the subjacent crate.

The supporting means may comprise generally hollow support posts which open out at the bottom surface of the floor of the crate and may at least partly define the secondary sockets.

According to one embodiment of the invention, the separating means may comprise free-standing separating posts projecting from the floor in spaced relationship. These posts may be arranged in rows. The wall may be provided with further spaced separating posts aligned with the free-standing posts. Thus, for example, a crate adapted to carry twelve bottles, may have six free-standing separating posts and these and the posts on the walls may be in a rectangular grid of five by four rows. The primary sockets may lie between four adjacent separating posts or between adjacent posts and the peripheral wall, as the case may be.

The separating posts, or at least the lower parts thereof, may be generally hollow and/or formed by suitable wall formations. They may be of a height greater than the height of the wall. The support posts in turn may have a height less than the height of the wall.

Adjacent separating posts and support posts may be interconnected by means of webs extending between them. The height of the webs may be approximately the same as or slightly less than that of the support posts.

To enable the crate to be stacked, when empty, receiving means in the form of sockets may be defined by the lower parts of the hollow separating posts, so that the tops of the separating posts of one crate can fit into the sockets of a higher identical crate spigot-socket fashion. Also, recesses can be formed in the walls, where appropriate, to facilitate this stacking.

According to another embodiment of the invention, some or all of the separating means may be in the form of planar partitions which may co-operate with separating posts and/or the peripheral wall to define primary sockets of substantially square cross-section.

The wall may include reinforcing means to improve the rigidity of the wall, although reinforcing may be provided by the hollow separating posts which are integral with the wall, if provided. The invention will now be described with reference to the accompanying diagrammatic drawings.

Figure 1:
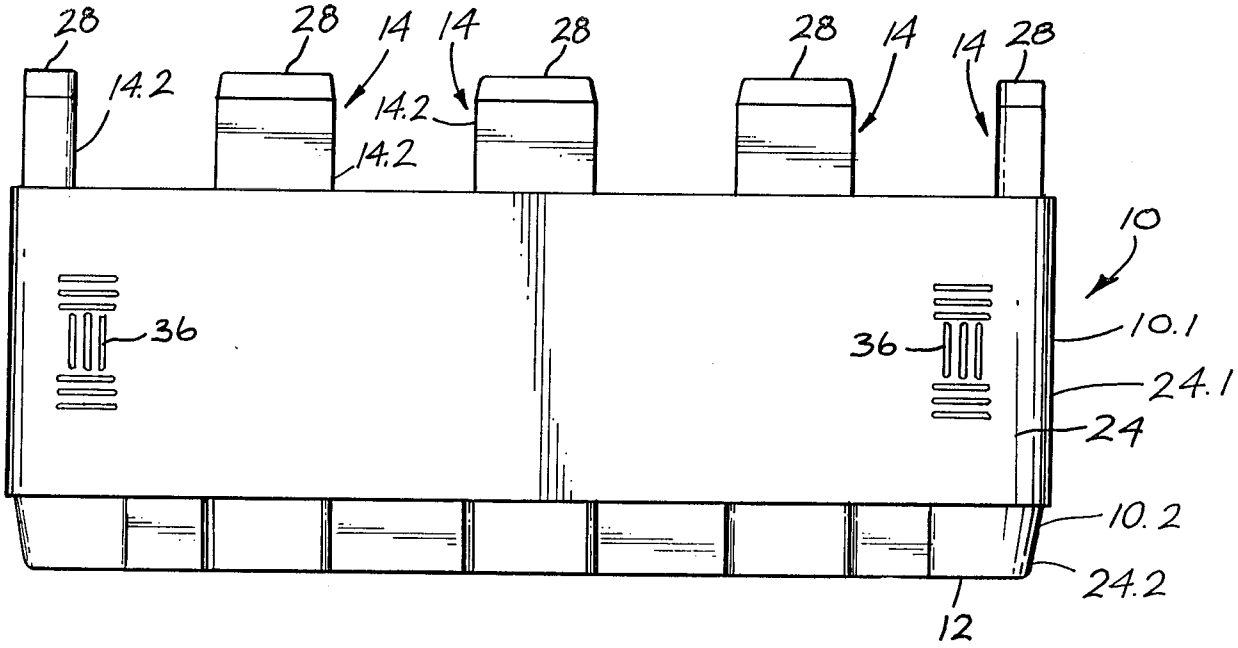
FIG. 1 shows a side view of a bottle crate according to one embodiment of the invention.
Figure 2:
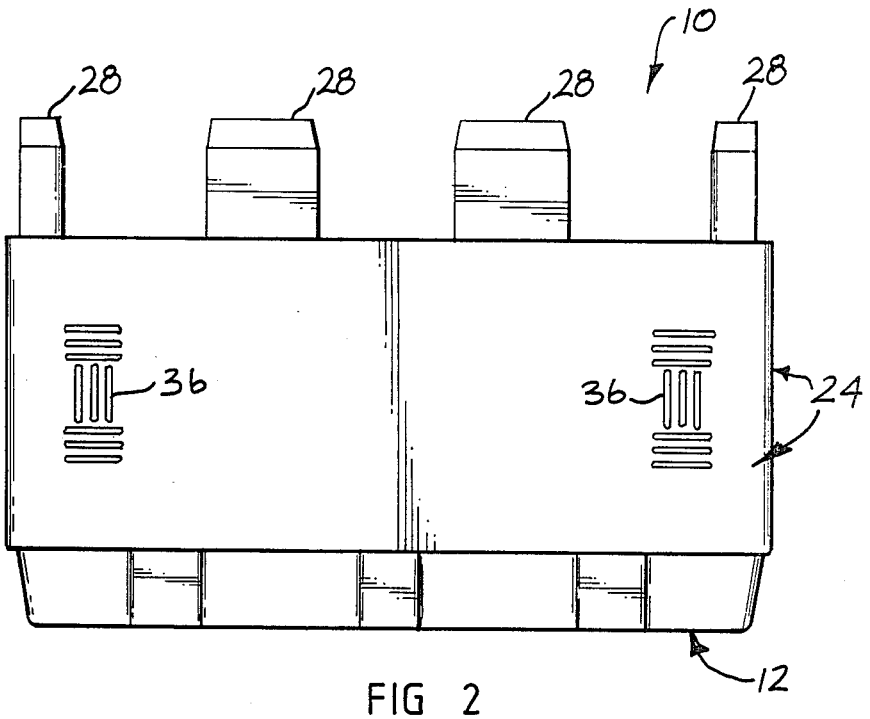
FIG. 2 shows an end view of the crate of FIG. 1.
Figure 6:
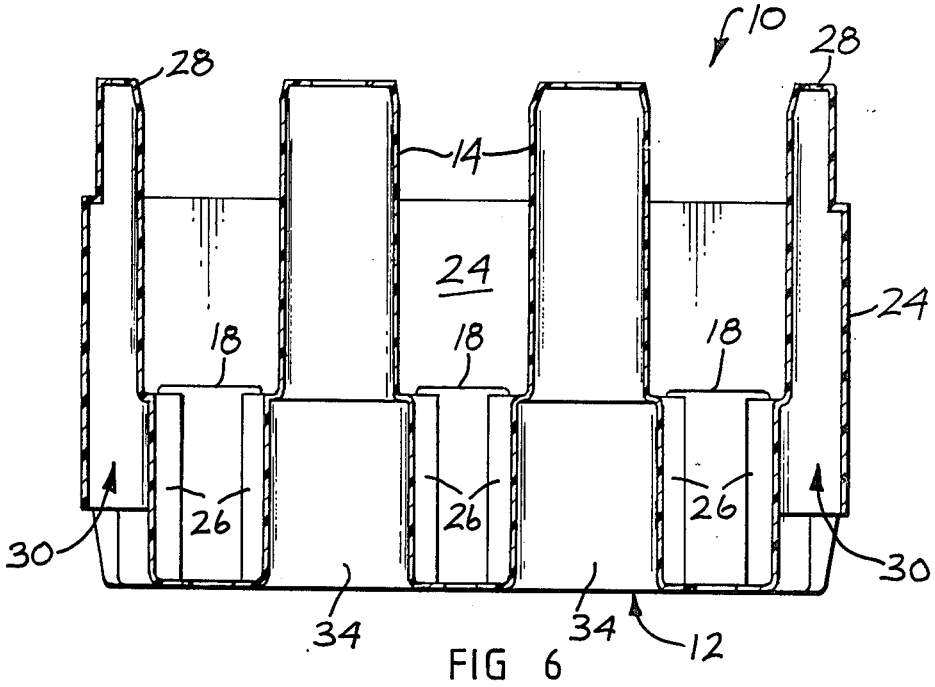
FIG. 6 shows a sectional end view of the crate of FIG. 1 taken along the lines VI—VI in FIG. 3.
Figure 3:
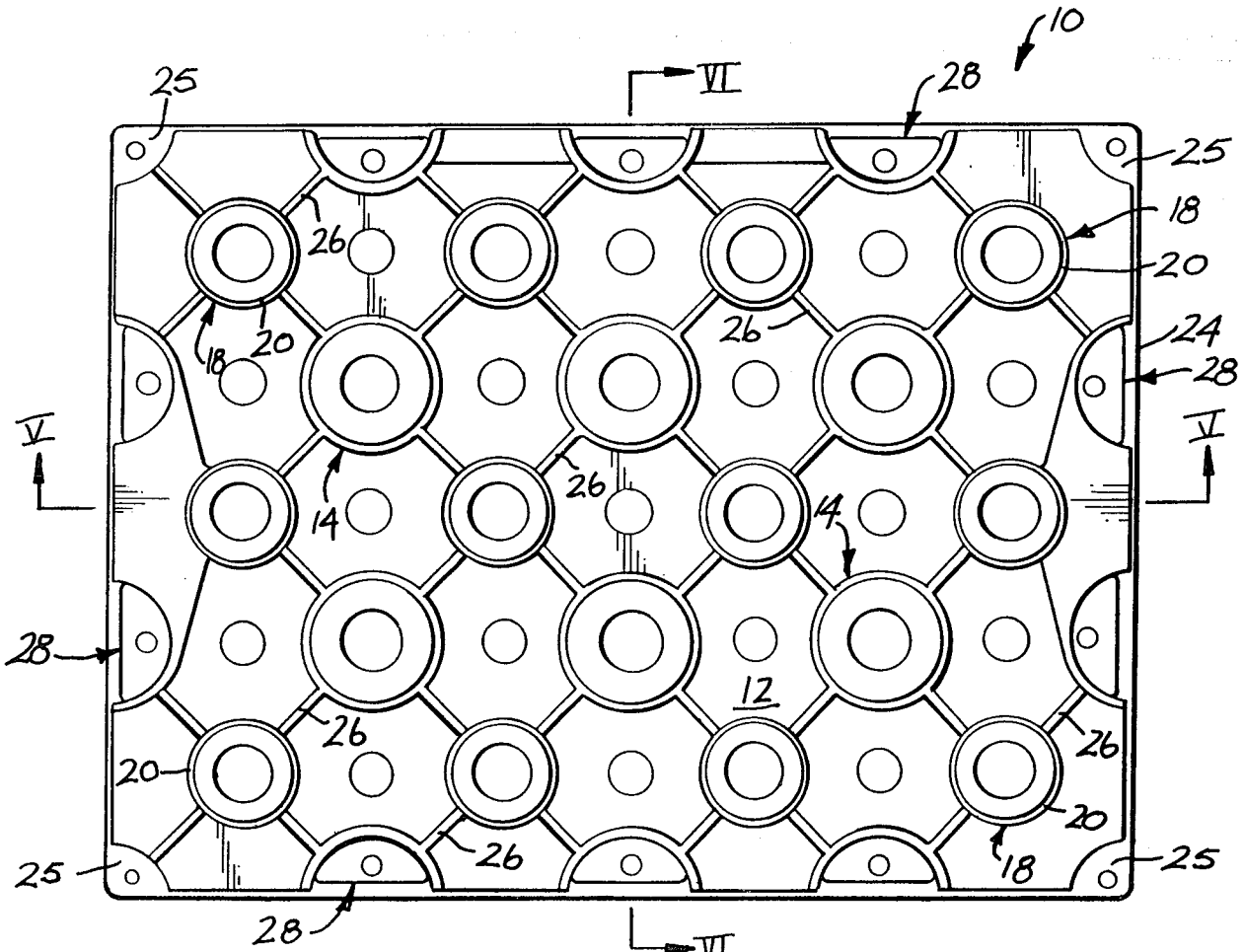
FIG. 3 shows a top plan view of the crate of FIG. 1.
Figure 4:
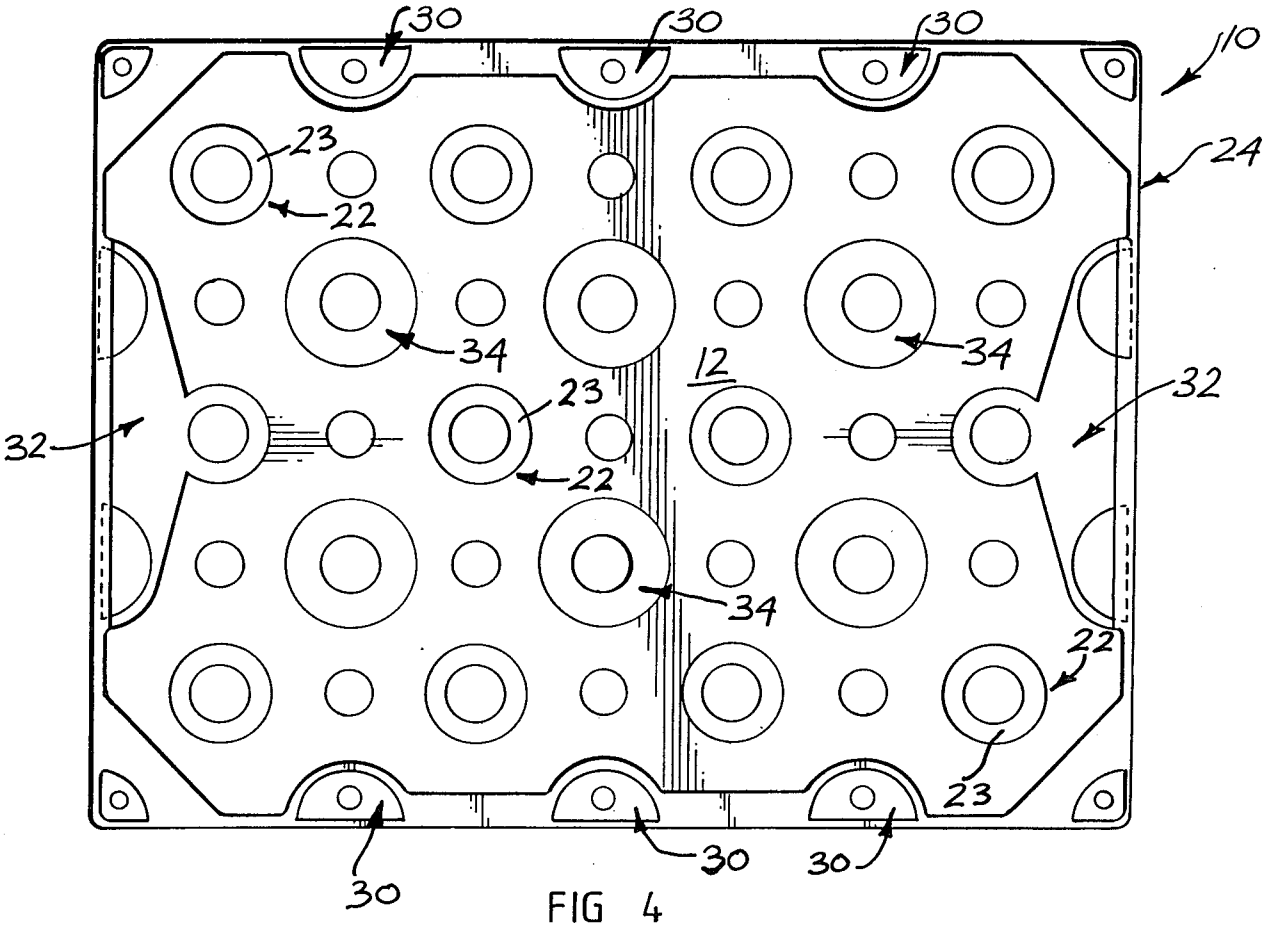
FIG. 4 shows an underplan view of the crate of FIG. 1.
Figure 5:
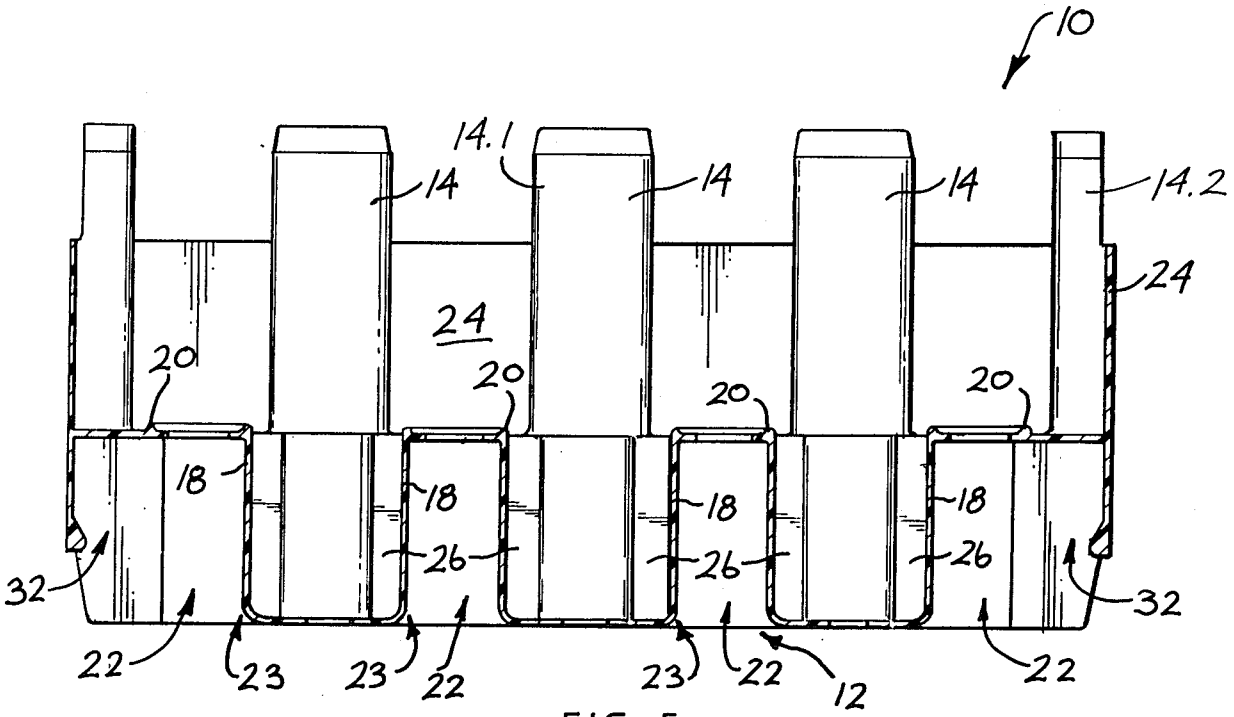
FIG. 5 shows a sectional side view of the crate of FIG. 1 taken along lines V—V in FIG. 3.
Figure 7:
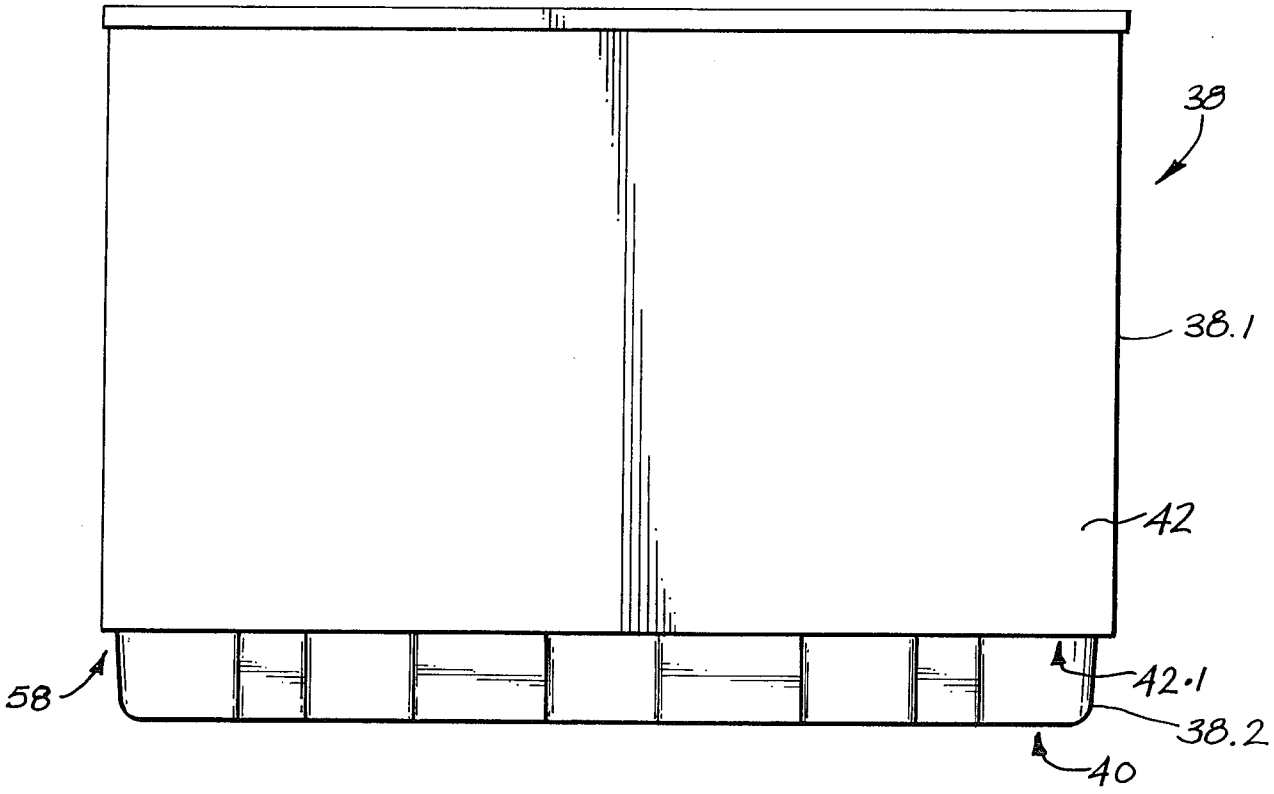
FIG. 7 shows a side view of a crate according to another embodiment of the invention.
Figure 8:
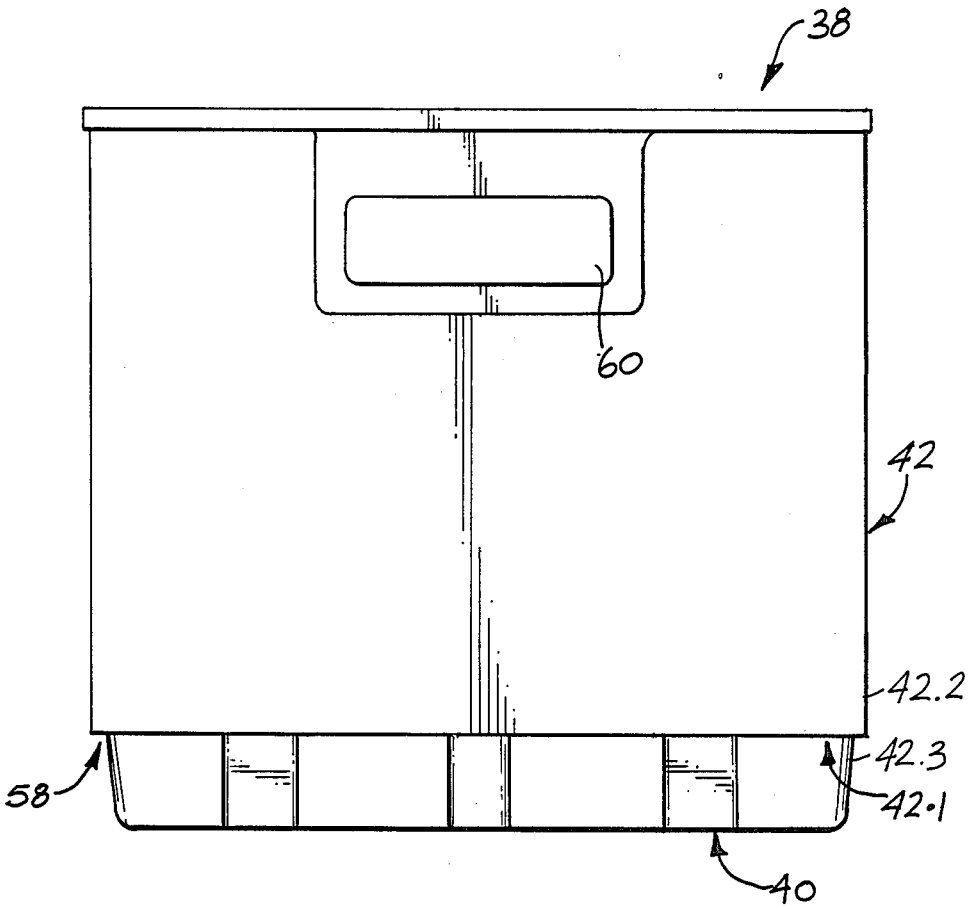
FIG. 8 shows an end view of the crate of FIG. 7.
Figure 9:
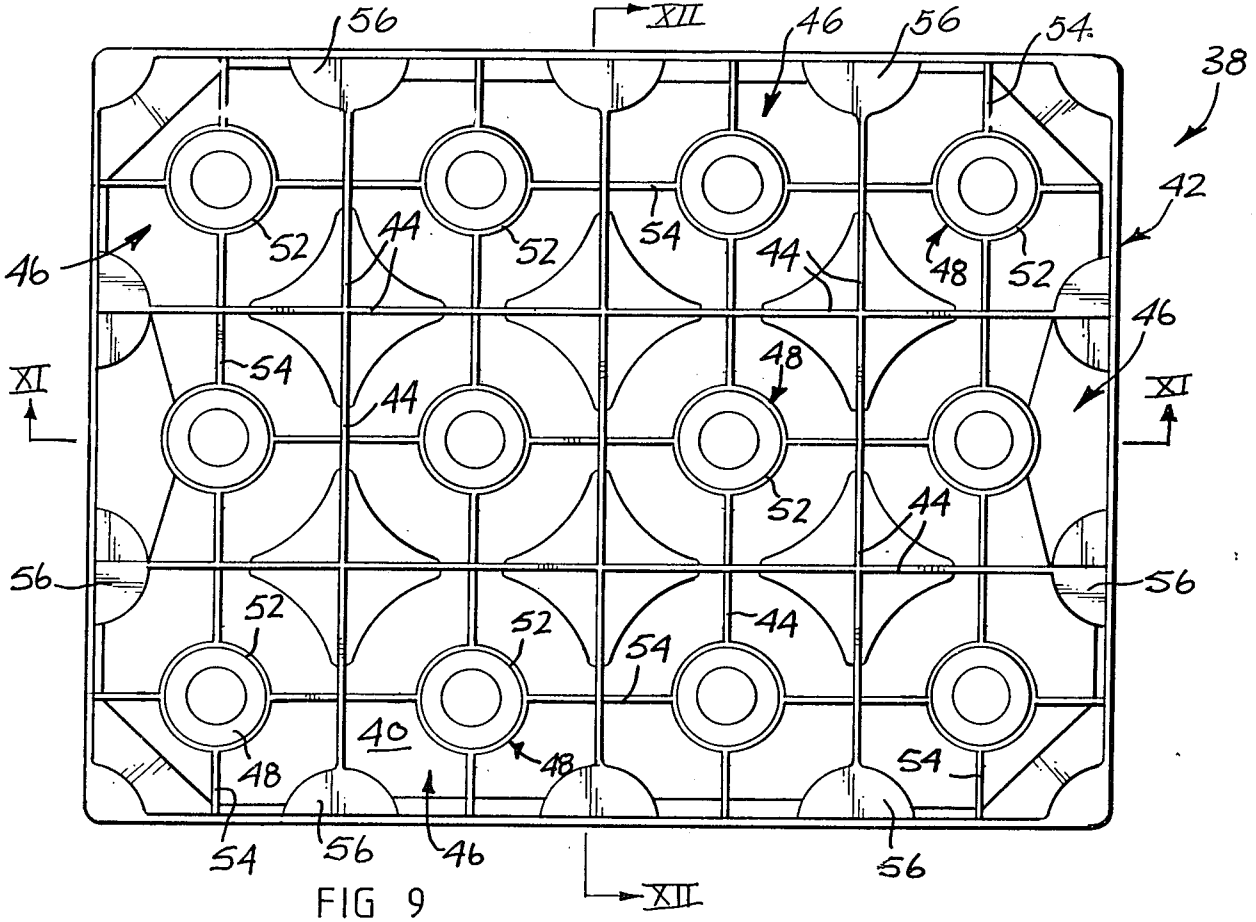
FIG. 9 shows a top plan view of the crate of FIG. 7.
Figure 10:
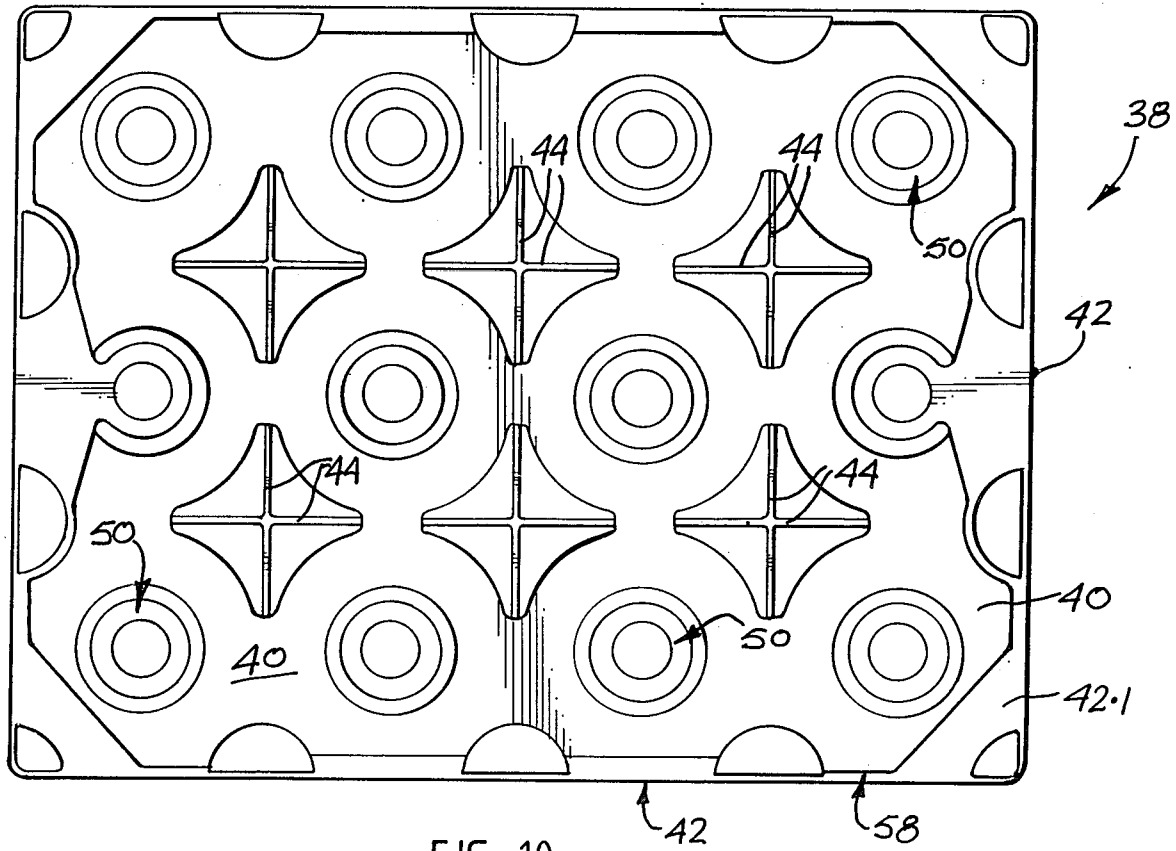
FIG. 10 shows an underplan view of the crate of FIG. 7.
Figure 11:
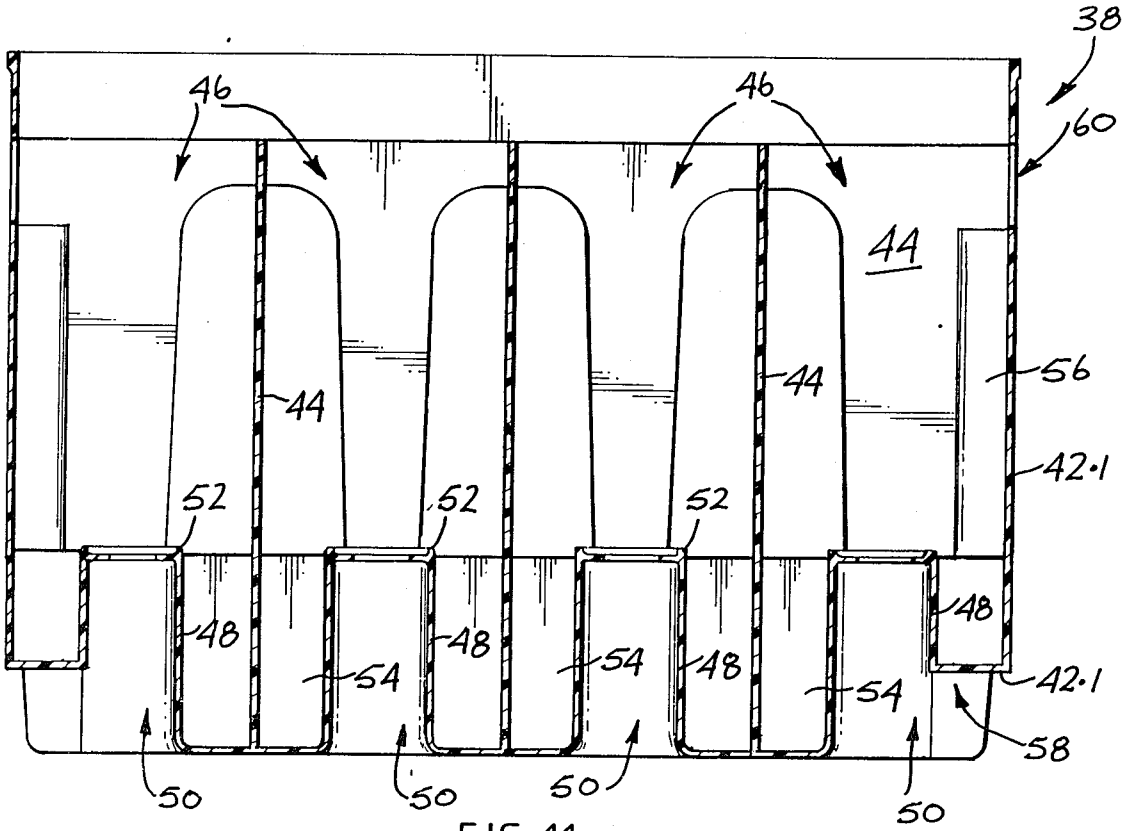
FIG. 11 shows a sectional side view of the crate of FIG. 7 taken along the lines XI—XI in FIG. 9.
Figure 12:
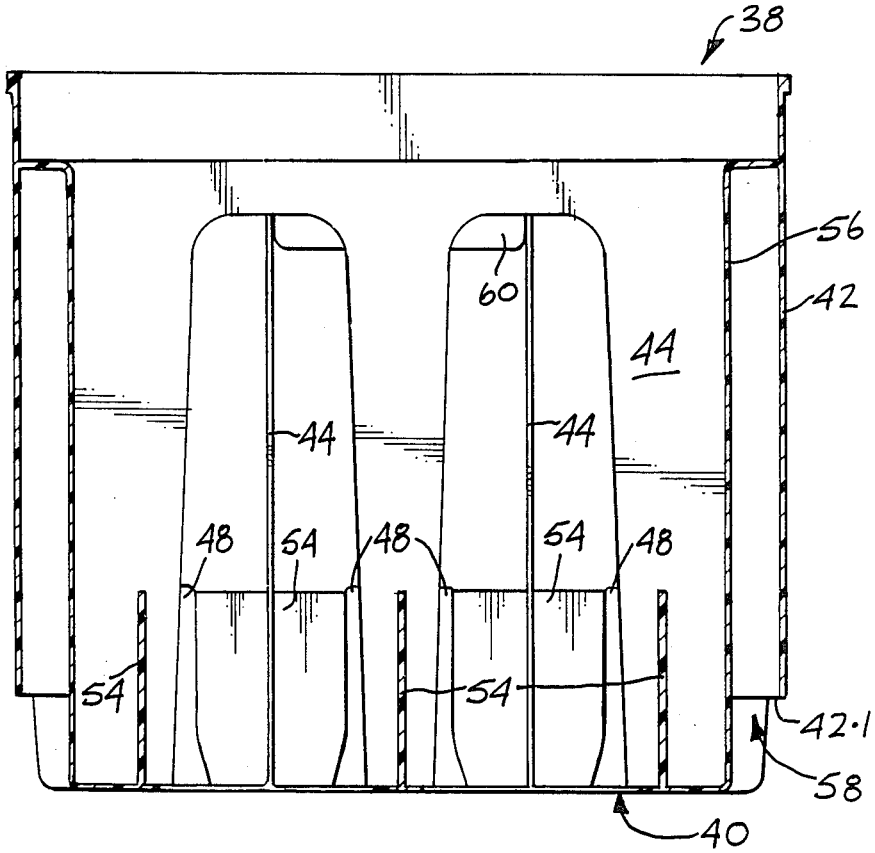
FIG. 12 shows a sectional end view of the crate of FIG. 7 taken along the lines XII—XII in FIG. 9.
Figure 13:
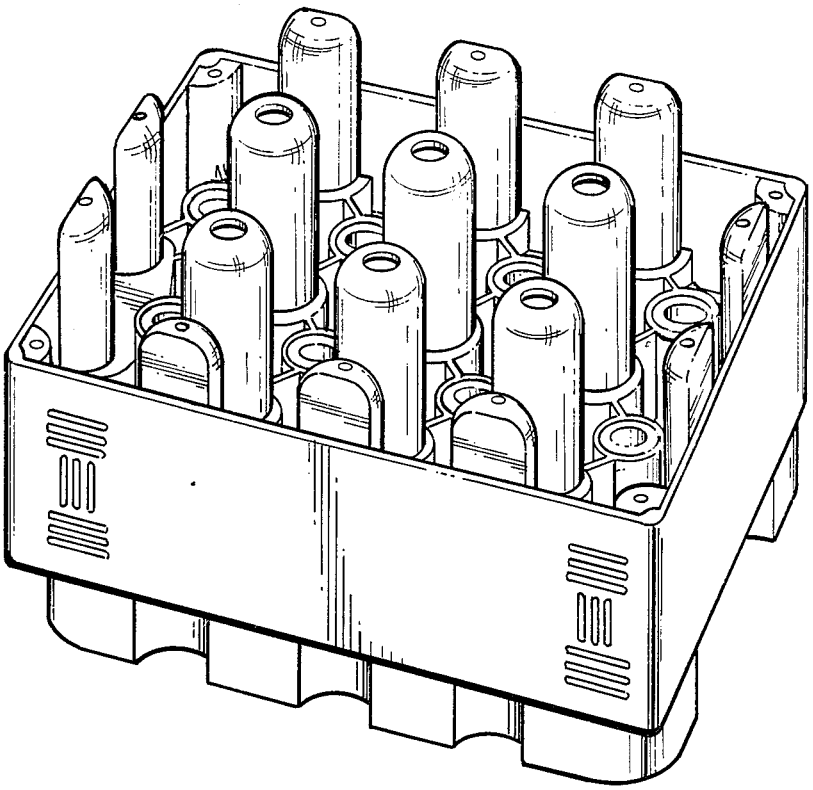

FIG. 13 shows an alternative crate. Referring to FIGS. 1 to 6, a bottle crate in accordance with one embodiment of the invention is designated generally by the reference numeral 10. The crate at 10 includes an upper part 10.1 and a connected lower part 10.2 including a floor, i.e. single, lowermost, relatively-smoth 12. Separating means are in the form of a plurality of separating posts at 14 (see, particularly, FIG. 3), including free-standing posts 14.1 extending in one direction, herein upwardly from the floor and correspondingly-extending posts 14.2 integral with a peripheral wall 24 of the crate, the posts being in spaced relationship in a rectangular grid pattern. These posts 14 at least partially define upwardly opening primary sockets (discussed in greater detail below) in which at least lower portions of bottles (not shown) are receivable. The peripheral wall 24 extends upwardly from and surrounds the floor 12.

The crate 10 further includes supporting means in the form of hollow support posts 18 projecting upwardly from the floor 12 to form a bottle-supporting seat for each primary socket. More specifically, each support post 18 has at its top a seat defined by an annular rib 20 on which a bottom of a bottle is supportable. The hollow support posts 18 extend from the floor 12 to a height less than that of the separating posts 14. The hollow support posts further define downwardly opening secondary sockets at 22 (FIG. 4) in the downward surface of the floor 12 within which neck portions of bottles in a subjacent crate are receivable in use. The mouth of each socket 22 has a bevelled edge 23 to define a peripheral surface or shoulder which, in use, sits on the neck portion of the bottle. The shoulder 23 provides a more even force distribution over the neck portion of the bottle, and also serves to facilitate transporting bottles of slightly differing dimensions.

The free-standing separating posts 14.1 are at least partly hollow and are of a height exceeding the height of the wall 24. The separating posts 14 and the support posts 18 are interconnected by webs 26 extending diagonally between adjacent posts 14, 18. The height of the webs 26 is approximately the same as that of the support posts 18.

The separating posts 14.2 integral with the wall are formed partly by locating formations formed by the wall and partly by extensions 28. These posts 14.2 also extend upwardly from the floor 12 and project upwardly beyond the top of the wall. The formations in the wall provide outer rebates in the wall. The extensions 28 are each hollow and have a substantially semicircular or D-shaped cross-section which tapers at its top. The hollow interiors of the extensions 28 provide sockets 30 (FIG. 4) aligned with the rebates and the rebates and sockets form receiving means with the rebates leading into sockets 30. In use the top parts of corresponding posts 14.2 of a subjacent crate can fit into the rebates and sockets, i.e. male/female, of the crate spigot-socket fashion when stacking empty crates.

The crate 10 includes gripping means 32 (FIG. 4) provided by recesses in the floor 12. The gripping means 32 serve as handles to enable the crate to be manoeuvred in use.

In use, the crate 10 is used for transporting bottles having elongated neck portions. In the example shown, the crate 10 is designed to carry twelve bottles. Hence, the crate has twelve primary sockets, into each of which a support post 18 projects. Four of these primary sockets are corner sockets each defined between two posts 14.2 adjacent respective corner portions 25 (FIG. 3) of the wall 24 and the adjacent free-standing post 14.1. Two further primary sockets are end sockets defined between pairs of posts 14.2 at the ends of the crate and the opposed pairs of free-standing 14.1, and four further primary sockets are side sockets defined between three posts 14.2 at each side of the crate and the opposed three free-standing posts 14.1 on each side of the crate, thus forming two side sockets on each side of the crate. A further two primary sockets are central sockets defined between the two rows of three free-standing posts 14.1. The bottles sit on the seats 20 of the support posts 18, and are held in position by the separating posts 14. The separating posts 14 also serve to prevent the bottles from coming into contact with each other.

One crate containing bottles is then stacked on top of another crate containing bottles so that those bottles in the subjacent crate have their neck portions received in the secondary sockets 22 of the upper crate. The upper crate is therefore supported on the bottles of the subjacent crate. The design of the sockets accordingly is such that undesirable tilting or rocking of the stacked crates is limited by engagement of the bottle necks with said sockets 22.

When empty crates are stacked, the separating posts 14 of a subjacent crate are received within openings 34 defined in the lower ends of the free-standing posts 14.1 of an upper crate and the tops of the posts 14.2 are received within the sockets 30 of the corresponding posts 14.2 of the upper crate.

In addition, the wall 24 has an upper part 24.1 in the upper part of the crate, and a lower part 24.2 in the lower part of the crate. The upper and lower wall parts meet at a stepped formation or rebate. Thus, when a crate is stacked on top of a subjacent crate, the lower part 10.2 of the crate fits within the upper part 10.1 of the subjacent crate, and the upper wall part 24.1 of the one crate rests on the upper part 24.1 of the subjacent crate. The top edge of the wall of the subjacent crate simultaneously abuts against the bottom edge of the wall of the top crate, in use.

Thus, the total height of the crate when stacked can be substantially less than the cumulative total height of the individual crates, (and can approximate the total height of the upper wall part 24.1). The engagement between the posts and sockets of adjacent crates gives a stack of empty crates stability and reduces the height of the stack to the cumulative height of the walls, for reduced storage space.

Ribs 36 are provided on the wall 24 of the crate 10. These ribs 36 serve to limit relative movement between adjacent side-by-side abutting crates, for example when a plurality of crates are lifted together onto or from a pallet.

Referring now to FIG. 7 to 12, a crate according to another embodiment of the invention is shown, and is designated generally by the reference numeral 38. The crate 38 has an upper part 38.1 and a lower part 38.2 which includes a floor 40. A peripheral wall 42 extends upwardly from, and surrounds the floor 40, and has an upper part 42.2 in the upper part of the crate, and a lower part 42.3 in the lower part of the crate.

Separating means in the form of planar partitions 44 extend upwardly from the floor 10 to define primary sockets 46 of substantially square cross-section. Support means in the form of hollow posts 48 extend upwardly from the floor 40 to form support seats for each of the sockets 46. In the embodiment shown, each post 48 has an annular rib 52 at its top to define a seat for a bottom of a bottle receivable within the sockets 46. The posts 48 open downwardly in the region of the floor 40 of the crate 38 and define secondary sockets 50 within which the neck portions of bottles in a subjacent crate are receivable, in use.

Webs 54, parallel to the partitions 44, extend between adjacent partitions 44 and the posts 48, and between the posts 48 and the wall 42, to give the floor 40 and the posts 48 additional rigidity.

The wall 42 includes reinforcing means in the form of hollow posts 56 to improve rigidity of the wall 42. The hollow posts 56 are moulded integrally with the wall 42.

The crate 38 further includes locating means in the form of a stepped formation or rebate 58 of the bottom edge 42.1 of the upper wall part 42.2. The rebate 58 permits a crate to be stacked on top of a subjacent empty crate so that the lower part of the upper crate fits within the upper part of the subjacent crate and rests on the posts 56 of the wall of the subjacent crate. The upper part of the wall of the subjacent crate then abuts against or is closely spaced from the bottom edge of the upper part of the wall of the upper crate, and is received in its rebate 58.

Handles 60 are provided near the tops of the side portions of the peripheral wall 42 of the crate 38 to permit the crate to be lifted in use.

In use, bottles are received within the primary sockets 46 of the crate 38. The top portions of the bottles project above the top of the wall 42. Another crate is then placed on top of the crate so that its lower part fits within the upper part of the subjacent crate 38. Simultaneously, the neck portions of the bottles in the subjacent crate are received within the sockets 50 of the upper crate. The interlocking of the crates provided by the rebate 58 and by the neck portions of the bottles fitting within the sockets 50 of the upper crate, improves the stability of a stack of crates. In this regard it is to be noted that the weight of the upper crate is carried by the bottles in the subjacent crate, the mouths of the sockets 50 of the upper crate resting on the necks of the bottles. These mouths may be bevelled for this purpose, as shown for the edges or shoulders 23 of FIGS. 1 to 6. The upper edge of the wall of the lower crate will be received in the rebate 58 of the upper crate, spaced slightly below the lower edge of the wall of the upper crate.

Earlier crates designed by the Applicant for a similar purpose have a relatively uneven bottom surface. Thus, when such crates are being transported on roller conveyors, for instance, the uneven bottom surface of the crates can cause bottles therein to be shaken. This is not always suitable for easy handling or when the crates are carrying glass bottles and/or when bottles in the crates are filled with gaseous liquids. It is accordingly an advantage of the crates 10 and 38 that they have relatively smooth bottom surfaces provided by their floors.

The crate of FIG. 14 is similar to that of FIGS. 1 to 6 but is modified in that the tops of the posts are rounded. The posts may also be modified in other ways.

What I claim is:

1. A bottle crate, comprising:

an upper part which is upwardly open;

a lower part connected to the upper part and comprising a single, lowermost, relatively-smooth floor, the lower part being receivable in the upper part of an identical, subjacent crate;

separating means extending upwardly from the floor at least partially for defining upwardly open primary sockets in which at least lower portions of bottles are respectively receivable;

supporting means above the floor at a height therefrom less than the extent of the separating means for providing each primary socket with a seat on which a lower part of a bottle received in the primary socket is supportable; and downwardly opening secondary sockets in the floor within which neck portions of bottles in the subjacent crate are respectively receivable in use, the secondary sockets having respective socket mouths with respective peripheral surface means for resting on the neck portions of the bottles in the subjacent crate.

2. A crate according to claim 1, which includes a peripheral wall extending upwardly from and surrounding the floor.

3. A crate according to claim 2, in which the floor is an elongated rectangle and the peripheral wall has two side portions and two end portions, the side and end portions being so shaped that an upper part of each portion forms part of the upper part of the crate and a lower part of each portion forms part of the lower part of the crate.

4. A crate according to claim 3, in which the portions are stepped into a stepped formation or rebate where the upper and lower parts of the wall meet, whereby to facilitate at least partial location of the lower part of the crate within the upper part thereof.

5. A crate according to claim 1, in which the supporting means project upwardly from the floor and at least partly define the secondary sockets.

6. A crate according to claim 5, wherein the supporting means comprises generally hollow support posts which open out at the bottom surface of the floor of the crate and define the secondary sockets.

7. A crate according to claim 2, wherein the separating means comprises free-standing separating posts projecting from the floor in spaced relationship.

8. A crate according to claim 7, wherein the wall is provided with further spaced separating posts aligned with the free-standing posts.

9. A crate according to claim 7, wherein at least the lower parts of the separating posts are generally hollow or formed by suitable wall formations.

10. A crate according to claim 8, wherein the separating posts are of a height greater than the height of the wall and the support posts have a height less than the height of the wall.

11. A crate according to claim 7, wherein the separating posts and support means are interconnected by means of webs extending between them.

12. A crate according to claim 7, wherein, to enable the crate to be stacked, when empty, receiving means are defined by the lower parts of the hollow separating posts and, if necessary, recesses in the wall, so that the tops of the separating posts of one crate can fit into the receiving means of a higher identical crate spigot-socket fashion.

13. A crate according to claim 2, wherein at least some of the separating means are in the form of planar partitions which co-operate with separating posts and the peripheral wall to define primary sockets of substantially square cross-section

* * * * *